United States Patent [19]

Flight

[11] Patent Number: 4,689,850

[45] Date of Patent: Sep. 1, 1987

[54] PULLEY MOUNT FOR WINDOW BALANCE SYSTEM

[75] Inventor: Robert S. Flight, Rochester, N.Y.

[73] Assignee: Caldwell Manufacturing Company, Rochester, N.Y.

[21] Appl. No.: 880,594

[22] Filed: Jun. 30, 1986

[51] Int. Cl.[4] ..... E05D 13/00

[52] U.S. Cl. ..... 16/197

[58] Field of Search ..... 16/197, 193, 196, 198, 16/199, 200, 201, DIG. 31, DIG. 16; 49/445, 446, 430; 267/179, 74, 61 R

[56] References Cited

U.S. PATENT DOCUMENTS

| | | | |
|---|---|---|---|
| 840,265 | 1/1907 | Sloan . | |
| 1,132,651 | 3/1915 | Clermont . | |
| 1,570,271 | 1/1926 | Minor . | |
| 2,715,747 | 8/1955 | Prosser et al. | 16/198 |
| 3,055,044 | 9/1962 | Dinsmore | 16/197 |
| 3,358,404 | 12/1967 | Dinsmore | 49/446 |
| 3,445,964 | 5/1969 | Foster | 16/197 |
| 3,676,956 | 7/1972 | Taylor | 49/446 |
| 4,068,406 | 1/1978 | Wood | 49/446 |
| 4,089,085 | 5/1978 | Fitzgibbon | 16/197 |
| 4,190,930 | 3/1980 | Prosser | 16/197 |
| 4,423,853 | 1/1984 | Davis, Sr. | 254/390 |
| 4,503,641 | 3/1985 | Swan | 49/445 |

*Primary Examiner*—Gene P. Crosby

*Attorney, Agent, or Firm*—Stonebraker, Shepard & Stephens

[57] ABSTRACT

A pulley mount for a window balance system 10 uses a pair of spaced-apart support plates 13 and 14 each having a shoulder rivet 30 with a shaft fitting through a hole 29 in each of support plates 13 and 14. A pair of pulleys 21,23 and 22,24 are mounted on each rivet, with one pulley mounted on the rivet shoulder 32, and another pulley mounted on a flanged bushing 35 around the rivet shaft. A support plate 13 for one pair of pulleys has a hook 12 for connecting to an end of a channel 11 containing the balance system, and a support plate 14 for another pair of pulleys has a coupler 17 connected to a balance spring 15.

32 Claims, 5 Drawing Figures

PULLEY MOUNT FOR WINDOW BALANCE SYSTEM

BACKGROUND

Block and tackle window balance systems, of which Dinsmore U.S. Pat. No. 3,358,404 is an example, have used conventional pulley blocks straddling a pair of pulleys mounted on an axle extending between the sides of the pulley block. This requires threading a cord through the space between the pulley block and a pulley periphery as the cord is reeved over each of at least four pulleys.

I have found a better way of mounting pulleys in a block and tackle window balance system. My pulley mount is less expensive, uses pulley mounting plates that also serve other functions, such as connecting to a channel and coupling to a spring, and speeds up the assembly time by allowing the cord to be looped rapidly over each pulley periphery, instead of being threaded through pulley blocks. My pulley mount thus achieves economy of manufacture and assembly combined with durable and reliable operation.

SUMMARY OF THE INVENTION

My pulley mount for a window balance system uses a pair of spaced-apart support plates for mounting each pair of pulleys on opposite sides of each support plate. I prefer that axles for each pulley pair be mounted in a hole in each support plate so that cantilevered portions of each axle support each pulley. I prefer that each pulley axle be formed of a shoulder rivet carrying a flanged bushing so that one pulley mounts on the rivet shoulder and the other pulley mounts on the flanged bushing. A riveted end of the rivet then draws the rivet shoulder tightly against one side of the support plate and traps the flanged bushing tightly against the other side of the support plate, forming equal diameter journals for each pulley. I also connect one of the support plates directly to a channel containing the window balance system, and I couple the other support plate to a spring for the balance system.

DRAWINGS

DETAILED DESCRIPTION

Figure 1:
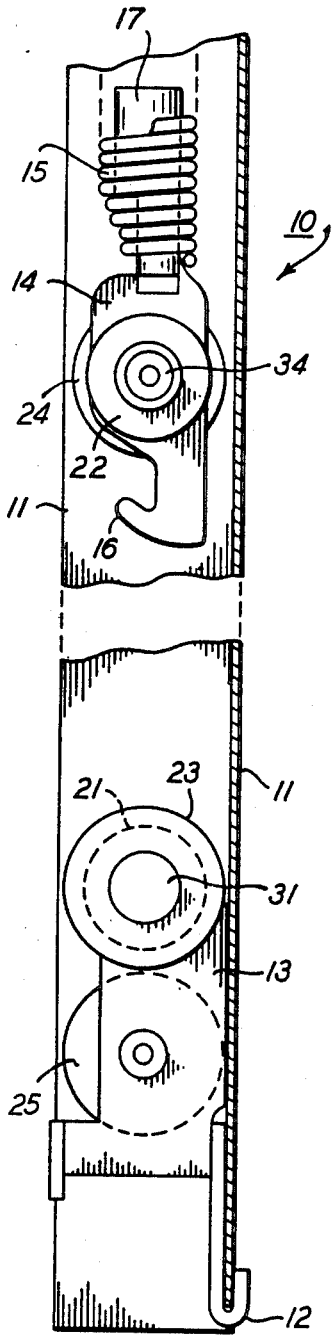
FIG. 1 is a partially cutaway side elevational view of a preferred embodiment of my pulley mount, with a cord for the pulley system removed to simplify the illustration.
Figure 2:
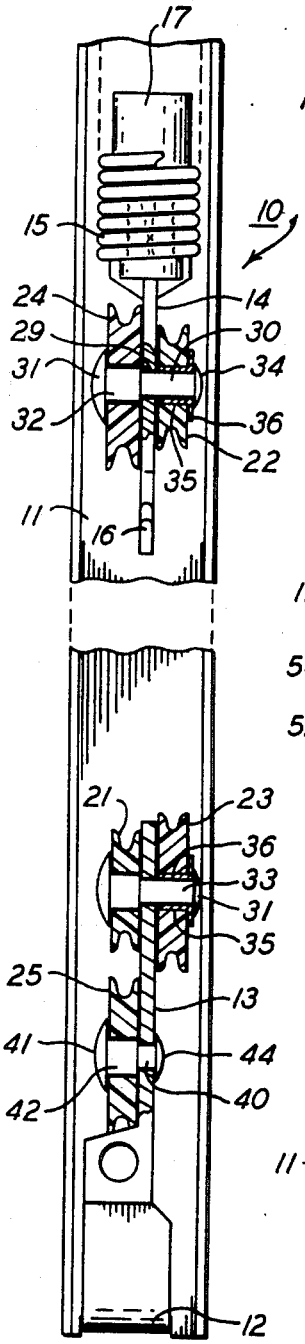
FIG. 2 is a partially cutaway plan view of the embodiment of FIG. 1.

The illustrated pulleys and pulley mounts for balance system 10 are arranged within channel 11 to distribute the force of spring 15 over the distance traveled by a window sash. System 10 uses five pulleys 21–25 mounted on two support plates 13 and 14, but four pulley systems are also possible. Support plate 13 is connected by a hook 12 to an end of channel 11, and support plate 14 is coupled to one end of spring 15, the other end of which is connected to channel 11. The pulley cord, which is not illustrated for system 10 because its presence obscures the pulleys and their mounts, has one end attached to hook 16 on support plate 14, from where the cord is reeved successively around pulleys 21–25 and extends from pulley 25 to a termination attached to the window frame or the sash, depending on where the balance system is arranged. Pulleys 21 and 23 are paired on opposite sides of support plate 13, pulleys 22 and 24 are paired on opposite sides of support plate 14, and pulley 25 is an output pulley in tandem with pulley 21. Support plates 13 and 14 are fabricated economically of sheet metal to include a hook 12 on support plate 13 for connecting to an end of channel 11 and a coupler 17 on support plate 14 for coupling to spring 15.

Each of the pulley pairs 21, 23 and 22, 24 is preferably mounted on a rivet 30 having a head 31, a shoulder 32, and a shaft 33 extending through a hole 29 in each of the support plates 13 and 14 and terminating in a riveted end 34. Around the shafts 33 of rivets 30 are arranged bushings 35 that preferably have flanges 36. As rivet ends 34 are riveted against bushing flanges 36, the rivets compress bushings 35 against one side of support plates 13 and 14, while drawing rivet shoulders 32 tightly against the other sides of support plates 13 and 14. The outside diameter of bushing 35 preferably equals the diameter of shoulder 32 so that pulleys with either large or small outside diameters can have equal inside diameters. The axial extent of shoulder 32 and bushing 35 is sufficient so that each pulley is free to rotate in the space between support plates 13 and 14 and either rivet heads 31 or bushing flanges 36.

Output pulley 25 preferably mounts on a single rivet 40 with a head 41, a shoulder 42, and a riveted end 44. Pulley 25 also preferably has a large diameter and is mounted in tandem with small diameter pulley 21.

The rivet mounting of pulleys 21–25 is not only simple and economical, but is durable and reliable. Rivets 30 and 40, cantilevered through support plates 13 and 14 to support pulleys 21–25 without any enclosing pulley block, allow a cord to be reeved rapidly over the pulleys by looping successively around their peripheries.

Figure 5:
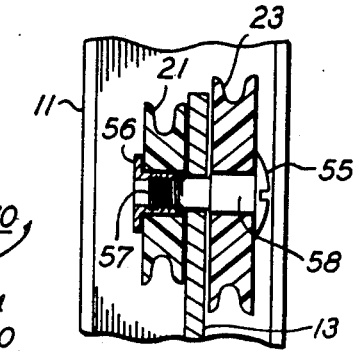
FIGS. 3–5 are fragmentary and partially cutaway views of alternative preferred pulley mounts for the balance systems of FIGS. 1 and 2.
Figure 4:
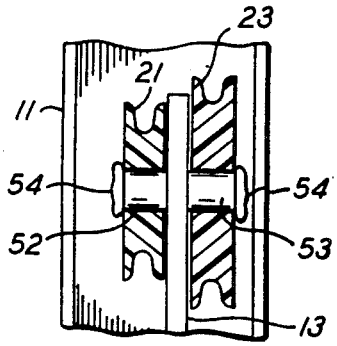
Figure 3:
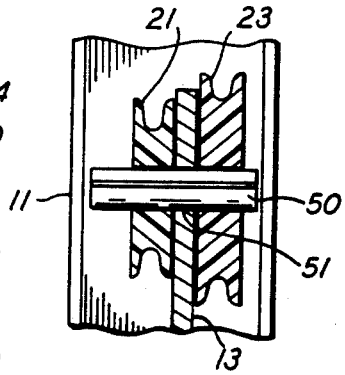

Although I prefer shoulder rivets 30 for several reasons, alternatives to these can be used as shown in FIGS. 3–5. The alternative illustrated in FIG. 3 uses roll pin 50 extending through a hole 51 in support plate 13 for mounting pulleys 21 and 23 within channel 11. Roll pin 50 is formed of a flat strip of sheet metal rolled into a tube that, once inserted into hole 51, tends to stay securely in place. A solid pin can also be used in place of roll pin 50. The side walls of channel 11 keep pulleys 21 and 23 from sliding axially off the ends of pin 50, but other means can be used for retaining the pulleys on pin 50, such as flaring the ends of pin 50 or pressing headed plugs into the ends of pin 50.

The alternative mount of FIG. 4 uses a die cast support plate 13 with molded cylindrical axles 52 and 53, which have peened ends 54 axially retaining pulleys 21 and 23. These can also be held on axles 52 and 53 by the side walls of channel 11, or by retainers on the axle ends 54.

The alternative of FIG. 5 uses shoulder screw 55, which is similar to shoulder rivet 30. Instead of having a riveted end, however, shoulder screw 55 has a flanged bushing 56 with internal threads threaded onto the shaft 57 of screw 55. Pulley 21 then turns on bushing 56 while pulley 23 turns on shoulder 58.

The alternatives of FIGS. 3–5 can be applied to either support plate and either pulley pair. All the alternatives share the common advantage of allowing the pulleys to be reeved with a cord looped rapidly around the pulley peripheries, without being threaded through a pulley block.

I claim:

1. A pully mount for a window balance system, said pulley mount comprising:

a. a support plate having a hole;

b. a shoulder rivet having a shaft fitting through said hole and a shoulder abutting against said support plate around said hole;

c. a pulley mounted on said shoulder between said support plate and a head for said rivet;

d. a bushing mounted on said rivet shaft; and e. another pulley mounted on said bushing between said support plate and a riveted end of said rivet.

2. The mount of claim 1 wherein said bushing has a flange adjacent said riveted end of said rivet.

3. The mount of claim 1 wherein said pulleys have equal inside diameters.

4. The mount of claim 3 wherein said pulleys have unequal outside diameters.

5. The mount of claim 1 wherein said support plate has a hook for attaching to a channel containing said window balance system.

6. The mount of claim 1 wherein said support plate has a coupler connected with a spring for said window balance system.

7. A mount for pulleys of a window balance system arranged within a channel, said mount comprising:

a. a pair of spaced-apart support plates, one of said support plates being connected with said channel and another of said support plates being connected to a spring within said channel;

b. pulley axles cantilevered outward from each side of each of said support plates;

c. a pulley mounted on each of said pulley axles so that the pulleys are arranged on each side of each of said support plates; and d. means for axially retaining said pulleys on said pulley axles.

8. The mount of claim 7 wherein each of said pulley axles comprises a cylindrically shaped element extending through and mounted in a hole in each of said support plates.

9. The mount of claim 7 wherein each of said pulley axles comprises a shouldered rivet and a flanged bushing arranged so that one of said pulleys mounts on a shoulder of said rivet and the other of said pulleys mounts on said flanged bushing.

10. The mount of claim 9 wherein said pulleys mounted on each of said pulley axles have equal inside diameters and unequal outside diameters.

11. The mount of claim 7 including a tandem pulley axle on one of said support plates mounting an output pulley in tandem with one of said pulleys.

12. The mount of claim 7 wherein said support plate connected with said channel has a hook engaging an end of said channel.

13. A method of mounting pulleys in a window balance system, said method comprising:

a. arranging a pair of pulleys on opposite sides of a support plate;

b. mounting said pulleys on a cylindrical element extending outward free of support from opposite sides of said support plate so that one of said pulleys turns freely on said cylindrical element on one side of said support plate, and another of said pulleys turns freely on said cylindrical element on another side of said support plate; and c. retaining said pulleys against axial movement away from said support plate.

14. The method of claim 13 including using a shouldered rivet for said cylindrical element, mounting one of said pulleys on a shoulder of said rivet on one side of said support plate, and mounting another of said pulleys on a flanged bushing around said rivet on another side of said support plate.

15. The method of claim 14 including riveting an end of said rivet to draw said shoulder against said support plate and trap said flanged bushing between said support plate and the riveted end.

16. The method of claim 15 including making the inside diameters of each of said pulleys equal.

17. The method of claim 13 including connecting said support plate to a channel containing said window balance system.

18. The method of claim 13 including connecting said support plate to a spring for said window balance system.

19. A mount for supporting a pair of pulleys on a common axis in a window balance system, said mount comprising:

a. a support plate having a hole on said axis;

b. a cylindrical element extending through said hole and arranged on said axis to extend outward free of support on opposite sides of said support plate;

c. two pulleys mounted on said cylindrical element, one pulley on each side of said support plate; and d. means for retaining said pulleys on said cylindrical element for rotating freely on said cylindrical element.

20. The mount of claim 19 wherein said cylindrical element is a shoulder rivet having a shoulder on one side of said support plate and a flanged bushing around said rivet on another side of said support plate.

21. The mount of claim 20 wherein said pulleys have equal inside diameters.

22. The mount of claim 21 wherein said pulleys have unequal outside diameters.

23. The mount of claim 19 wherein said support plate has a hook for connecting said support plate with a channel containing said window balance system.

24. The mount of claim 19 wherein said support plate has a coupler connected to a spring for said window balance system.

25. A mounting arrangement for pulleys of a window balance system, said mounting arrangement comprising:

a. a pair of spaced-apart pulley axles having a pair of pulleys mounted on each axle;

b. each of said pulley axles being mounted in a hole in a respective support plate so that each pulley axle is cantilevered outward free of support from each side of said support plate; and c. means for axially retaining said pair of pulleys on each of said pulley axles so that said pulleys are on opposite sides of said support plate and so that a cord can be reeved freely around said pulleys without being threaded through a pulley block.

26. The arrangement of claim 25 wherein said pulley axles are each formed as a shouldered rivet with a shoulder on one side of said support plate and a flanged bushing around said rivet on an opposite side of said support plate.

27. The arrangement of claim 26 wherein the inside diameters of said pulley are equal, and the outside diameters of said pulleys of each of said pairs are unequal.

28. The arrangement of claim 25 wherein said support plate has a hook connected to a channel containing said window balance system.

29. The arrangement of claim 25 wherein said support plate is coupled to a spring for said window balance system.

30. A pulley mount for a window balance system arranged in a channel, said pulley mount comprising:

a. a support plate arranged between and parallel with opposite side walls of said channel;

b. pulley axles extending outward from opposite sides of said support plate toward said side walls of said channel;

c. a pulley mounted on each of said pulley axles so that the pulleys are on opposite sides of said support plate and are between said support plate and said channel walls; and d. means for axially retaining said pulleys on said pulley axles.

31. The pulley mount of claim 30 wherein said pulley axles are formed on a cylindrical element extending through a hole in said support plate.

32. The pulley mount of claim 31 wherein said cylindrical element is a shoulder rivet with a shoulder on one side of said support plate and a flanged bushing on another side of said support plate.

* * * * *